United States Patent [19]

Barczak et al.

[11] Patent Number: 4,746,498

[45] **Date of Patent: * May 24, 1988**

[54] PROCESS FOR REDUCING GASEOUS SULFUR DIOXIDE CONTENT OF FLUE GASES BY PREHEATING COALS PRIOR TO BURNING SUCH COALS AND BY CONTROLLING COMBUSTION TEMPERATURE LEVELS

[75] Inventors: Virgil J. Barczak; John O. Bodman; John A. L. Campbell, all of Oklahoma City, Okla.

[73] Assignee: Kerr-McGee Coal Corporation, Oklahoma City, Okla.

[ * ] Notice: The portion of the term of this patent subsequent to Feb. 24, 2004 has been disclaimed.

[21] Appl. No.: 644,597

[22] Filed: Aug. 27, 1984

[51] Int. Cl.[4] ..... B01J 8/00; C01B 17/00; F23J 11/00; F23B 7/00

[52] U.S. Cl. ..... 423/244; 110/343; 110/345

[58] Field of Search ..... 423/242 A, 242 R, 244 A, 423/244 R; 110/343, 345

[56] References Cited

U.S. PATENT DOCUMENTS 4,059,060 1/1977 Gambs et al. ..... 110/343 X
4,302,218 11/1981 Friedman ..... 423/244 X

FOREIGN PATENT DOCUMENTS 396969 8/1933 United Kingdom ..... 423/242

*Primary Examiner*—Gregory A. Heller
*Attorney, Agent, or Firm*—William G. Addison; John P. Ward

[57] ABSTRACT

The present invention contemplates a process for reducing the gaseous sulfur dioxide content of flue gases by either or both preheating coal prior to burning the preheated coal and controlling the combustion temperature level to control the amount of sulfur being converted to sulfates and remaining in the ash residue.

2 Claims, 2 Drawing Sheets

PROCESS FOR REDUCING GASEOUS SULFUR DIOXIDE CONTENT OF FLUE GASES BY PREHEATING COALS PRIOR TO BURNING SUCH COALS AND BY CONTROLLING COMBUSTION TEMPERATURE LEVELS

CROSS REFERENCE TO RELATED APPLICATIONS

The subject matter of the present application is related to that described in the copending application entitled "Reducing Sulfur Content In Flue Gases Produced By Coal Combustion", Ser. No. 425,262, filed Sept. 28, 1982, and assigned to the assignee of the present invention, and to that described in the copending application entitled "Process for Treating Coal To Reduce Sulfur Content In Flue Gases Produced By Coal Combustion", Ser. No. 425,263, filed Sept. 28, 1982, and assigned to the assignee of the present invention.

BACKGROUND OF THE INVENTION

1. Field of the Invention

The present invention relates to methods for reducing the gaseous sulfur content of flue gases and, more particularly, but not by way of limitation, to a process for reducing the gaseous sulfur oxide content of flue gases produced by combustion of coal wherein either or both the coal is preheated prior to combustion and the combustion temperature levels are controlled.

2. Brief Description of the Prior Art

Sulfur-containing coals, when ordinarily combusted, produce flue gases which contain sulfur oxides. Because environmental considerations dictate strict limitations on the amount of sulfur oxides which may be released to the atmosphere, considerable attention has been devoted by those skilled in the art to reducing the gaseous sulfur oxide levels in flue gases. Unless gaseous sulfur oxide levels in flue gases are reduced to acceptable levels, the flue gases produced by many types of coal cannot be released to the atmosphere. The prior art has generally focused on reducing sulfur content in flue gases by reducing sulfur oxides either to elemental sulfur or to hydrogen sulfide or by absorbing sulfur oxides in lime-containing scrubbers.

DESCRIPTION OF THE PREFERRED EMBODIMENT

It has been discovered that gaseous sulfur content of flue gases was reduced by burning coals containing weakly bound cations of either alkali metal or alkaline earth metals or both in ion exchangeable form, which resulted in a substantial portion of the sulfur in the coal to be converted to sulfates and retained in the ash residue. In particular, such coals contain weakly bound cations of either alkali metal or alkaline earth metals or both in stoichiometric excess of the amount necessary to bind with the sulfur inherent in the coal. The alkali metal or alkaline earth metals preferably are calcium and the coals having the above described characteristics, more particularly, are characterized as subbituminous and lignite. In addition, it was discovered that the gaseous sulfur content of flue gases further was reduced if at least a portion of the flue gases were contacted by such coals to sorb a portion of the sulfur dioxide in such flue gases on such coals, the coals so contacted being subsequently transferred to a combustion zone for burning. A process for reducing the gaseous sulfur oxide content of flue gases by burning coals of the specific type just described was disclosed in detail in the copending application entitled "Reducing Sulfur Content In Flue Gases Produced By Coal Combustion", Ser. No. 425,262, filed Sept. 28, 1982, and assigned to the assignee of the present invention, the description in this application specifically being incorporated herein by reference.

Further, it has been discovered that the gaseous sulfur content of flue gases significantly was reduced, as compared to the process just described above, when these particular coals were contacted with at least a portion of the flue gases in the presence of water to maintain, during such contacting, a relatively high moisture content. This last-mentioned improved process was disclosed in detail in the copending application entitled "Process For Treating Coal To Reduce Sulfur Content In Flue Gases Produced By Coal Combustion", Ser. No. 425,263, filed Sept. 28, 1982, and assigned to the assignee of the present invention, the description in this application specifically being incorporated herein by reference.

In general, the present invention contemplates a process for reducing the gaseous sulfur content of flue gases by preheating the particular coals just described at a preheat temperature level for a preheat period of time prior to burning such coals in a combustion zone. Also, in the process of the present invention, the gaseous sulfur content of flue gases further is controlled by controlling the combustion temperature levels. The particular coals referred to herein are coals containing weakly bound cations of either or both alkali metal or alkaline earth metals or both in ion exchangeable form, and such coals were described in detail in the two patent applications mentioned before and incorporated herein by reference.

Figure 1:
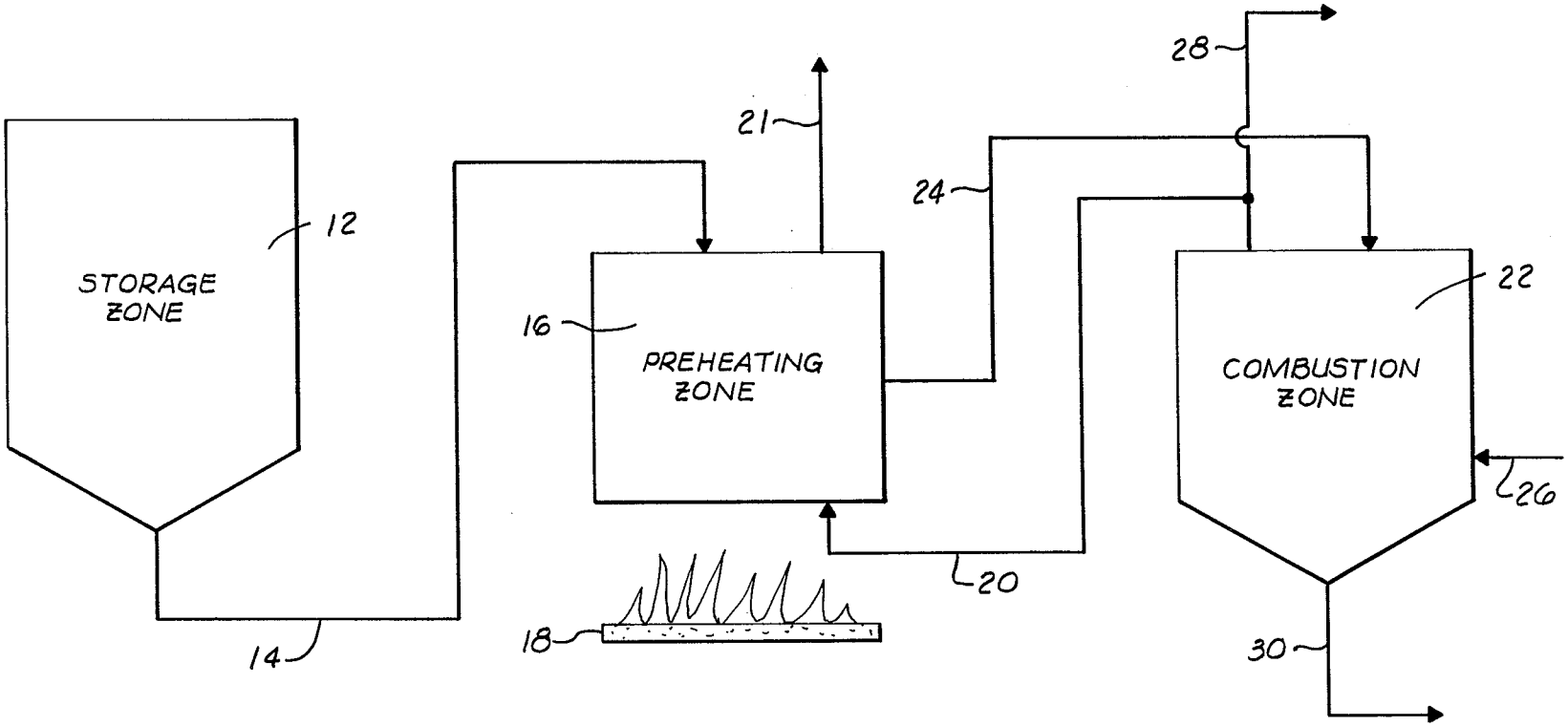
FIG. 1 is a schematic view illustrating the process of the present invention.

Referring to FIG. 1, coal is stored in a storage zone 12 and the coal is transferred or passed from the storage zone 12 through a conduit 14, which may be a conveyor, chute or other suitable transport means, to a preheating zone 16. In the preheating zone 16, the coal is preheated at a preheat temperature level over a predetermined preheat period of time.

The heat supplied to the preheating zone 16 may be supplied by any convenient heating means, such as a gas burner 18 shown in FIG. 1, for example. In one preferred embodiment, at least some of the heat for preheating the coal is supplied by some portion or all of the heated flue gases which are passed through a conduit 20 into the preheating zone 16, the flue gases being passed from a combustion zone 22. Any gases, such as flue gases, for example, which are transferred to or produced in the preheating zone 16, are passed from the preheating zone 16 through a conduit 21.

The preheated coal is transferred or passed from the preheating zone 16 through a conduit 24, which may be a conveyor or chute or other transport means, into the combustion zone 22. In the combustion zone 22, the coal and oxygen are burned at a combustion temperature level for a combustion period of time. The oxygen is passed into the combustion zone 22 through a conduit 26.

The burning of coal and oxygen in the combustion zone 22 produces flue gas and an ash residue. The flue gases are passed from the combustion zone 22 through a conduit 28 and the conduit 20 is connected to the conduit 28 for passing at least a portion of the flue gas into the preheating zone 16, as mentioned before. Ash residue containing sulfur, largely in the form of calcium sulfate, is transferred or passed from the combustion zone 22 through a conduit 30, which also may be a conveyor or chute or other transport or recovery means. It should be noted that an electrostatic precipitator may be interposed in the conduit 28 prior to the connection of the conduit 20 to the conduit 28.

If the flue gases or at least a portion of the flue gases are passed into the preheating zone 16, the heated flue gases then will contact the coal and heat from such flue gases is utilized to preheat the coal at the preheat temperature level, thereby conserving some energy in the process rather than simply dissipating such heat by passing all of the flue gas to atmosphere through the conduit 28. In addition, the contacting of the coal in the preheating zone 16 by the flue gases or at least a portion of the flue gases results in the coal sorbing a portion of the sulfur dioxide in the flue gas, thereby further reducing the gaseous sulfur oxide in the flue gases released through the conduit 21. In some applications, some of the heat required in the preheating zone 16 may be supplied by the flue gases and some may be supplied from some other source, such as the burner 18, for example.

Figure 2:
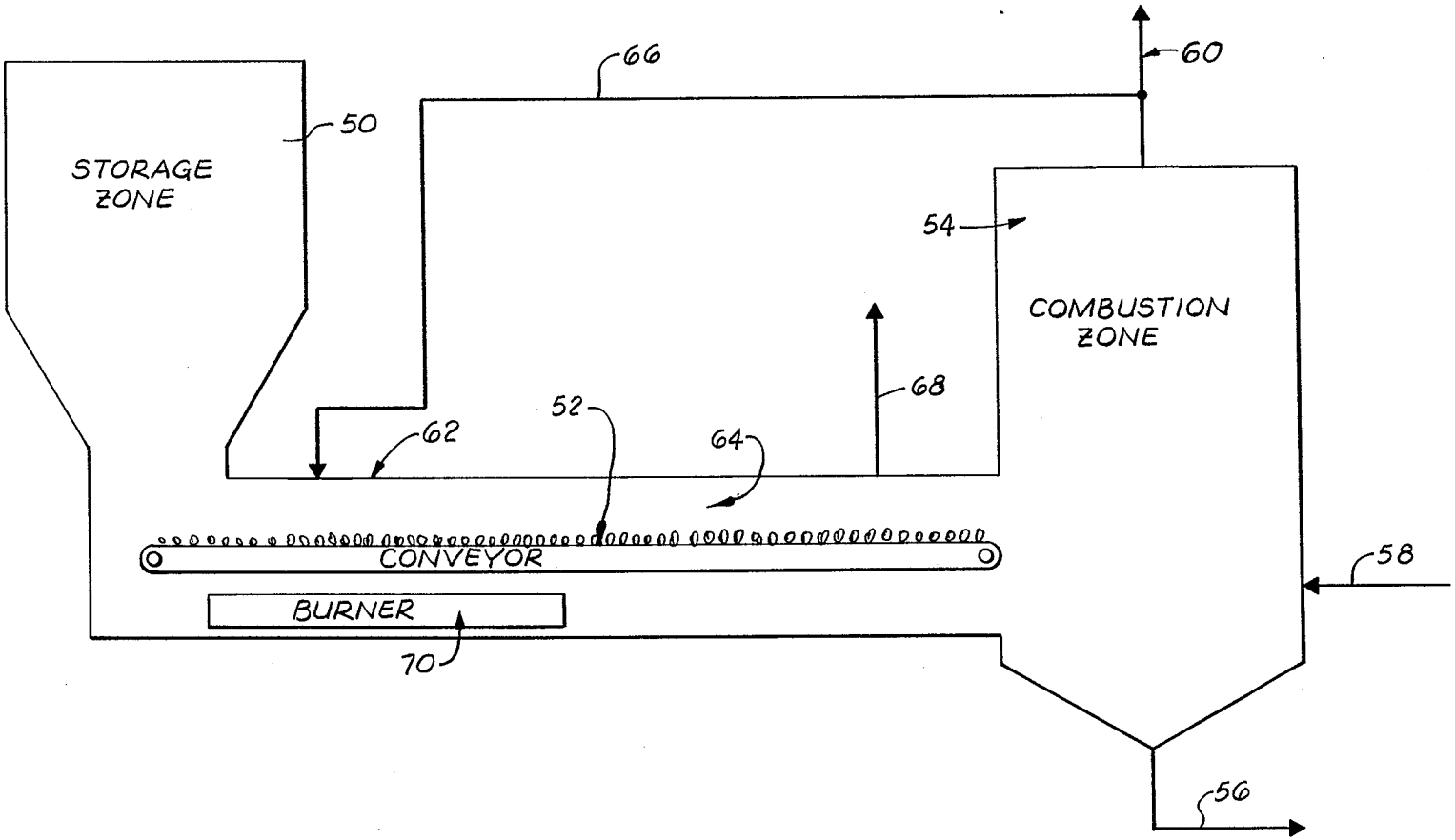
FIG. 2 is a schematic view illustrating another embodiment of the process of the present invention.

A modified process is schematically shown in FIG. 2 wherein coal is stored in a storage zone 50 and coal from the storage zone 50 is passed onto a conveyor 52 for transporting the coal to a combustion zone 54, the coal being passed from the conveyor 52 into the combustion zone 54. The coal is burned in the combustion zone 54 at the combustion temperature level, thereby producing flue gases and an ash residue in the manner exactly like that described before with respect to the combustion zone 22, the ash residue being recovered or passed from the combustion zone 54 through a conduit 56, which may be a conveyor or chute or other transport or recovery means and oxygen being passed into the combustion zone 54 through a conduit 58. The flue gases produced in the combustion zone 54 are passed from the combustion zone 54 through a conduit 60.

A hood 62 surrounds the conveyor 52 so the conveyor 52 extends through and is disposed within the opening formed through the hood 62. The opposite ends of the hood 62 are closed in the sense that one end of the hood 62 is connected to the storage zone 50 and the opposite end of the hood 62 is connected to the combustion zone 54. The hood 62 encompasses a space within which the conveyor 52 is disposed and this space forms a preheating zone 64.

Thus, in the embodiment of the process illustrated in FIG. 2, the coal is preheated in the preheating zone 64 at the preheat temperature level for the preheat period of time prior to the coal being passed into and burned in the combustion zone 54. In this embodiment, the speed of the conveyor 52 considered along with the length of the conveyor 52 in a particular application are controlled to control the preheat period of time. At least a portion of the flue gases are passed through a conduit 66 and into the preheating zone 64 and the gases produced in the preheating zone 64 may be passed from the preheating zone 66 through a conduit 68 which is connected to the hood 62. In a particular embodiment, the flue gases may be passed into the preheating zone 64 at several spaced apart positions along the length of the hood 62. It should be noted that an electrostatic precipitator may be interposed in the conduit 60 prior to the connection of the conduit 66 to the conduit 60.

As shown in FIG. 2, a burner 70 is disposed in the preheating zone 64 for supplying heat to the preheating zone 64 to heat the coal in the preheating zone 64 to the preheat temperature level. In particular embodiments, the flue gases may be sufficient to supply all of the required heat to the preheating zone 64 thereby eliminating the need for the burner 70 or the flue gases may supply some of the heat while the remaining required heat is supplied by the burner 70 or all of the required heat may be supplied by the burner 70.

The preheat temperature level and the preheat period of time are predetermined to be less than the temperature and the time required for complete combustion of the coal. It has been found that preheating the coal prior to combusting the coal in a combustion zone results in an increase in the amount of sulfur in the coal being retained in the ash residue remaining after combustion of the coal and thus the preheating of the coal results in reducing the sulfur oxide content in the flue gases produced as a result of burning or combusting the coal in a combustion zone.

In particular, the present invention contemplates preheating the coal at preheat temperature levels of at least 100° C. and less than about 600° C. for the preheat period of time. In general, preheating the coal at these preheat temperature levels even for relatively small preheat periods of time (seconds) will provide improved results (more sulfur retained in the ash residue) as compared to combustion of the same coal without any preheating. However, the preheat period of time preferrably is above at least one (1) minute.

Samples of coal of the specific coals defined before were preheated in a muffle furnace overnight at various preheat temperature levels in an oxygen atmosphere. The samples then were burned in oxygen at a higher combustion temperature level and the ash then was analyzed for sulfur content.

The approximate compositions of the coals tested is shown in Table I below. As indicated in Table I, the alkaline earth metal elements present in the coal described in Table I primarily are in the form of calcium in ion exchangeable form. A comparison of the calcium content with the sulfur content reveals a molar excess of calcium cations in this coal, which is preferred in a coal utilized in the process of the present invention.

TABLE I

CHEMICAL AND PHYSICAL PROPERTIES OF COAL TESTED

| | NO. 1 | NO. 2 |
|---|---|---|
| COAL | | |
| Total Sulfur (Wt %) | 0.44 | 0.44 |
| Total Water (Wt %) | 27.3 | 32.5 |
| Ca (Wt %) | 0.86 | 0.86 |
| Ca in Coal Water (mg/l) | 36 | 600 |
| Ca in Coal Water as Wt % of Total Ca | 0.1 | 2.2 |
| Inorganic $CO_2$ (Wt %) | 0.015 | 0.014 |
| Major Minerals Detected by X-ray Diffraction[1] | quartz ($SiO_2$), pyrite ($FeS_2$) kaolinite ($Al_2O_3.2SiO_2.2H_2O$) | quartz, pyrite, kaolinite |
| Ash (Wt %) | 5.49 | 5.94 |
| Surface Area ($m^2/g$)[2] | 15.1 | 10.4 |
| ASH | | |

TABLE I-continued

| CHEMICAL AND PHYSICAL PROPERTIES OF COAL TESTED | NO. 1 | NO. 2 |
|---|---|---|
| Total Sulfur (Wt %) | 8.36 | 7.66 |
| Sulfur as Wt % of Total Sulfur in Coal | 107.7 | 103.5 |
| Major Crystalline Phases Detected by X-Ray Diffraction | $CaSO_4$, quartz | $CaSO_4$, quartz |

[1]Heavy minerals were separated by placing coal in a liquid having a density of approximately 1.5 g/cm$^3$.
[2]Surface area determined by BET nitrogen method which, in the case of coal, yields relative rather than true values.

The data tabulated from the tests described above utilizing the coal described in Table I, Coal No, 1, are shown in Table II below.

TABLE II

ANALYTICAL DATA ON COAL ASH SAMPLES

| Combustion Temperature Levels (C.°) | Ash (Wt %) | Sulfur in Ash (Wt %) | Amount of Sulfur Retained in Ash (Wt %) |
|---|---|---|---|
| Head (analyzed according to ASTM procedures)[1] | 5.43 | 5.44 | 70.33 |
| Coal Not Preheated | | | |
| 500 | 5.37 | 5.08 | 64.95 |
| 600 | 5.15 | 4.28 | 52.59 |
| 700 | 5.27 | 4.29 | 53.83 |
| 800 | 4.98 | 4.27 | 50.61 |
| 900 | 4.78 | 4.53 | 51.55 |
| 1000 | 4.23 | 4.31 | 43.40 |
| Preheated at 300° C. then Burned at Combustion Temperature Levels (°C.) | | | |
| 700 | 5.58 | 6.48 | 86.07 |
| 800 | 5.53 | 6.33 | 83.33 |
| 900 | 5.45 | 6.36 | 82.52 |
| 1000 | 5.24 | 5.23 | 66.50 |
| Preheated at 400° C. then Burned at Combustion Temperature Levels (°C.) | | | |
| 700 | 5.54 | 5.77 | 76.12 |
| 800 | 5.47 | 5.84 | 76.04 |
| 900 | 5.46 | 6.00 | 78.00 |
| 1000 | 5.46 | 6.05 | 78.64 |
| Preheated at 500° C. then Burned at Combustion Temperature Levels (°C.) | | | |
| 700 | 5.49 | 5.04 | 64.69 |
| 800 | 5.32 | 5.03 | 63.71 |
| 900 | 5.32 | 5.07 | 64.21 |
| 1000 | 5.28 | 5.10 | 64.17 |
| Preheated at 600° C. then Burned at Combustion Temperature Levels (°C.) | | | |
| 700 | 4.20 | 4.22 | 42.19 |
| 800 | 4.93 | 4.34 | 50.95 |
| 900 | 4.94 | 4.41 | 51.88 |
| 1000 | 4.94 | 4.51 | 53.05 |

[1]American Society for Testing Materials (ASTM) Methods D 3177-75 Sulfur and D 3174-73 (Ash) 1979 Annual Book of ASTM Standards, Part 26, Philadelphia, PA 19103.

In additional tests, coal having the characteristics shown in Table I above, Coal No. 1, was preheated at various preheat temperature levels ranging from 200° C. to 500° C. for various preheat periods of time ranging from 1.0 hours to 24 hours and, then, the preheated coal was burned or combusted at 650° C. After combustion the ash residue was analyzed to determine the weight percent sulfur retained in the ash and this data is summarized in Table III below.

TABLE III

WEIGHT % SULFUR RETAINED IN ASH FOR PREHEATED COAL NO. 1 FOLLOWED BY HEATING AT A COMBUSTION TEMPERATURE LEVEL OF 650° C. FOR FOUR HOURS

| Preheat Period of Time (hrs.) | Preheat Temperature (°C.) 200 | 300 | 400 | 500 |
|---|---|---|---|---|
| 1 | 61.4 | 58.2 | 63.9 | — |
| 2 | 83.2 | 74.3 | 81.3 | 75.7 |
| 4 | 85.4 | 80.5 | 75.4 | 75.3 |
| 8 | (lost sample) | 81.2 | 82.5 | 77.4 |
| 24 | 83.3 | 80.5 | 81.7 | 63.3 |

It also has been discovered that the amount of the sulfur in the coal which is retained in the ash residue is a function of the combustion temperature level. Coal of the type described in Table I above, Coal No. 2, was combusted at various combustion temperature levels and the results of these tests are summarized in Table IV below. The particle size of the coal utilized in the tests summarized in Table IV was −200 mesh.

TABLE IV

| Combustion Temperature Level (°C.)[1] | Sulfur Retained in Coal Ash (Weight %) |
|---|---|
| 1150 | 1.77 |
| 1050 | 2.45 |
| 950 | 7.87 |
| 850 | 48.45 |
| 750 | 56.82 |
| 650 | 55.53 |
| 550 | 62.12 |
| 450 | 72.40 |
| 350 | 2 |
| 250 | 2 |

[1]Combustion temperature level refers to the furnace temperature level when the coal was combusted. The actual temperature level of the burning coal was appreciably higher in most cases.
[2]Combustion was not complete in 33 hours.

The results summarized in Table IV above show that lower combustion temperature levels strongly favor sulfur retention in the ash residue. Thus, by controlling the combustion temperature level, the amount of sulfur in the coal which is retained in the ash residue, can be controlled. It is common for combustion temperature levels to be about 1000° C. and, in these instances, the combustion temperature level can be controlled by lowering the combustion temperature level thereby increasing the amount of sulfur in the coal which is retained in the ash residue and lowering the gaseous sulfur dioxide in the resulting flue gases. Particularly, it is contemplated to control the combustion temperature level within a range from about 450° C. to about 1000° C.

As mentioned before, the sulfur sorbing efficiency of the preferred coals specifically described before substantially is increased if the contacting of the flue gases with the coals occurs in the presence of water to maintain, during such contacting, a relatively high moisture content. Thus, the preheating zone 16 (FIG. 1) may be adapted to retain water with the coal being disposed in such water and the flue gases then are passed through the coal-water slurry for contacting the coal with such flue gases. If the moisture contents of the coal is sufficiently high, additional moisture may not have to be added to the preheating zone 16 to accomplish the increased sorbing efficiency. Also, it may be desirable in some applications to add moisture to the coal before transferring the coal to the preheating zone 16, such as in the storage zone 12, for example.

Changes may be made in the construction, operation and arrangement of the various parts, elements, steps and procedures described herein without departing from the concept and scope of the invention as defined in the following claims.

What is claimed is:

1. A process for reducing the gaseous sulfur oxide content of flue gases produced by burning coal, comprising the steps of:

transporting coal containing sulfur and weakly bound cations selected from the group consisting of alkali metals and alkaline earth metals in ion exchangeable form from a storage zone to a combustion zone;

preheating the coal, while so transporting the coal from the storage zone to the combustion zone, at a preheat temerature level ranging from about 200° C. to less than about 600° C. for a preheat period of time ranging from at least one minute to less than the time required for complete combustion of such coal by contacting the coal to be preheated with at least a portion of the flue gases produced by burning the coal and passed from the combustion zone, the flue gases providing at least some of the heat for preheating the coal;

burning the preheated coal in the combustion zone at a combustion temperature level and for a combustion period of time thereby producing heated flue gases and an ash residue, a substantial portion of the sulfur in the coal being converted to sulfates remaining in the ash residue thereby reducing the gaseous sulfur dioxide content in the flue gases produced by burning such coals; passing the flue gases from the combustion zone; and controlling the combustion temperature level in the combustion zone within a range of from about 450° C. to about 1000° C. to increase the amount of sulfur being converted to sulfates and remaining in the ash residue.

2. A process for reducing the gaseous sulfur oxide content of flue gases produced by burning coal, comprising the steps of:

preheating coal containing sulfur and weakly bound cations selected from the group consisting of alkali metals and alkaline earth metals in ion exchangeable form at a preheat temperature level ranging from about 200° C. to less than about 600° C. for a preheat period of time ranging from above at least one minute to less than the time required for complete combustion of such coal by contacting the coal to be preheated with at least a portion of the flue gases produced by burning the coal and passed from a combustion zone for preheating the coal;

burning the preheated coal in the combustion zone at a combustion temperature level and for a combustion period of time thereby producing heated flue gases and an ash residue, a substantial portion of the sulfur in the coal being converted to sulfates remaining in the ash residue thereby reducing the gaseous sulfur dioxide content in the flue gases produced by burning such coals;

passing the flue gases from the combustion zone; and controlling the combustion temperature level in the combustion zone within a range of from about 450° C. to about 1000° C. to increase the amount of sulfur being converted to sulfates and remaining in the ash residue.

* * * * *